United States Patent [19]

Streit

[11] 4,345,526

[45] Aug. 24, 1982

[54] SHELVING DISPLAY AND SUPPORT

[75] Inventor: Kenneth F. Streit, Mt. Prospect, Ill.

[73] Assignee: Techplastics, Inc., West Chicago, Ill.

[21] Appl. No.: 101,095

[22] Filed: Dec. 7, 1979

[51] Int. Cl.[3] ..... A47B 47/00

[52] U.S. Cl. ..... 108/111; 108/101; 108/153; 108/159; 211/205; 248/159

[58] Field of Search ..... 108/101, 111, 150, 159, 108/153; 403/24, 25, 167, 173, 178; 16/135, 138, 171, 167; 248/159; 206/821

[56] References Cited

U.S. PATENT DOCUMENTS

| | | | |
|---|---|---|---|
| 1,281,104 | 10/1918 | Unger | 108/111 X |
| 1,686,291 | 10/1928 | Moore | 108/101 |
| 2,595,542 | 5/1952 | Robbins | 108/101 |
| 2,689,050 | 9/1954 | Albin | 108/101 |
| 3,235,903 | 2/1966 | Anderson | 16/167 |
| 3,276,400 | 10/1966 | Brunette | 108/111 |
| 3,310,180 | 3/1967 | Neagle | 211/205 |
| 3,339,752 | 9/1967 | Trogan | 248/159 X |
| 3,437,060 | 4/1969 | Giambalvo | 108/101 |
| 3,985,083 | 10/1976 | Pofferi | 108/111 |

FOREIGN PATENT DOCUMENTS

| | | | |
|---|---|---|---|
| 548614 | 6/1956 | Belgium | 108/111 |
| 319435 | 6/1934 | Italy | 108/150 |

*Primary Examiner*—James T. McCall

*Attorney, Agent, or Firm*—Dressler, Goldsmith, Shore, Sutker & Milnamow, Ltd.

[57] ABSTRACT

An injection molded, foam plastic, knockdown display stand and shelf support. The display stand is formed from a set of shelves supported by a unique pair of interlocking complementary V-shaped shelf supports. The shelf supports and shelves are indexed to a central pole. The pole is joined to a base support. Each of the V-shaped shelf supports is identical. Each V-shaped shelf support defines edges for supporting the shelves and contains hooks for joining the shelf support to the pole. Several variations of hooks are described. The shelf supports can be used independently of the display stand to support multiple tiers of shelves.

11 Claims, 9 Drawing Figures

FIG. 1
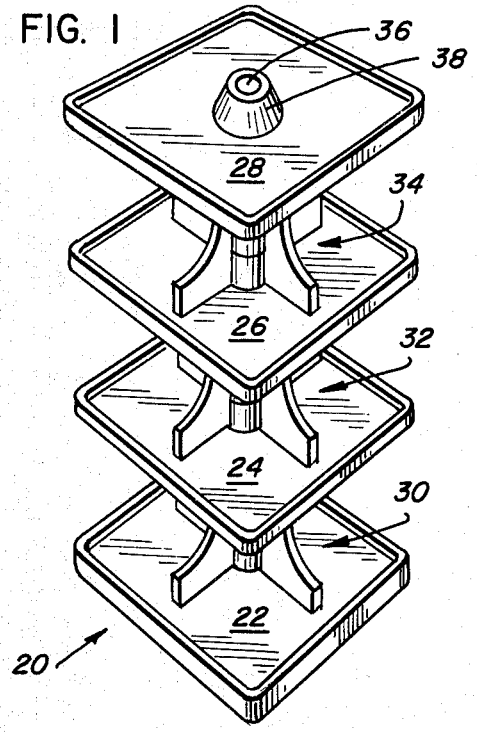
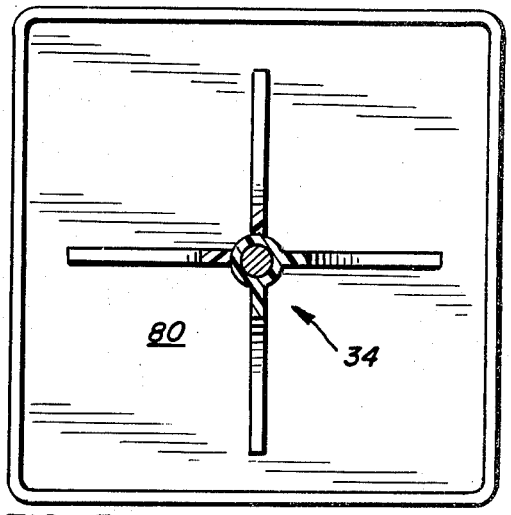
FIG. 5
FIG. 4
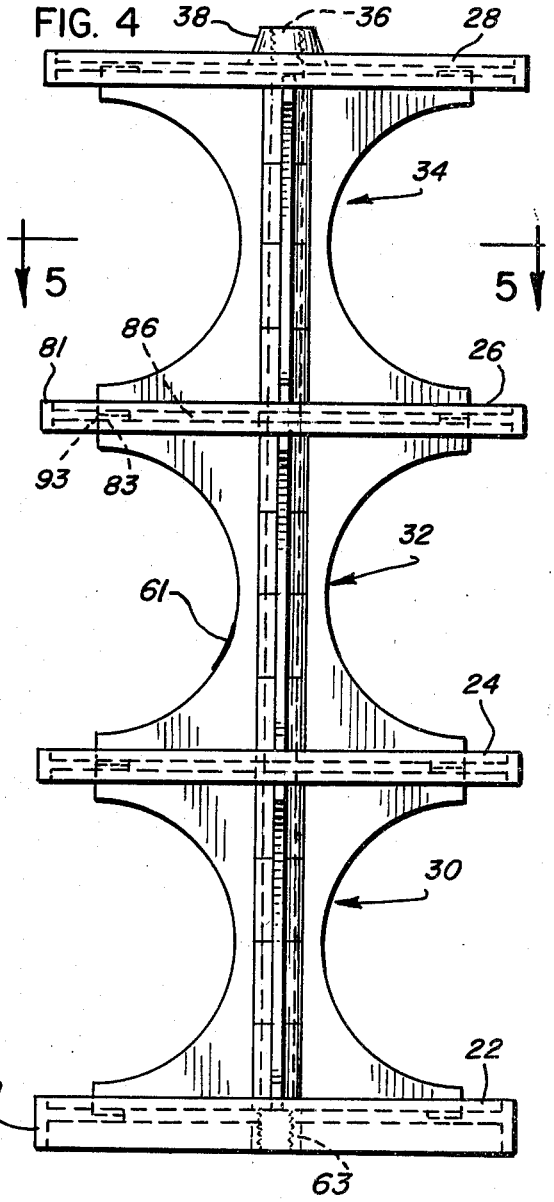
FIG. 2
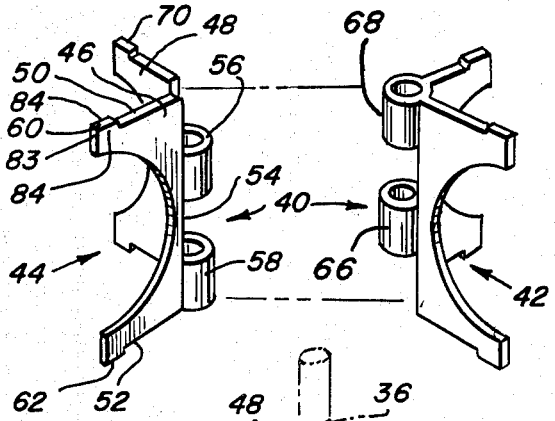
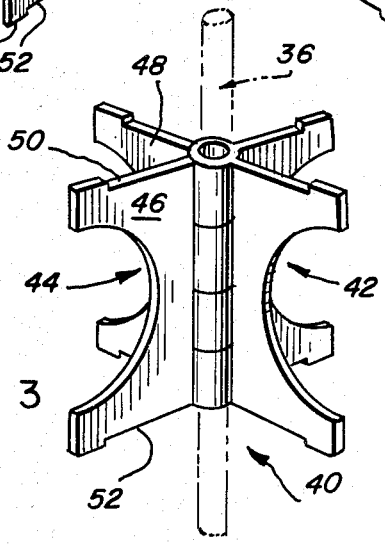
FIG. 3

FIG. 6
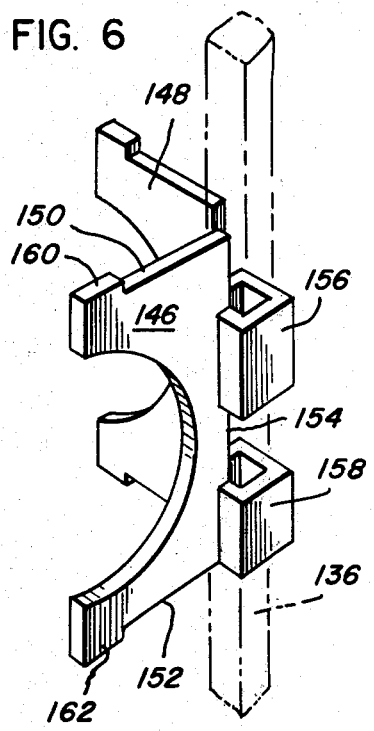
FIG. 7
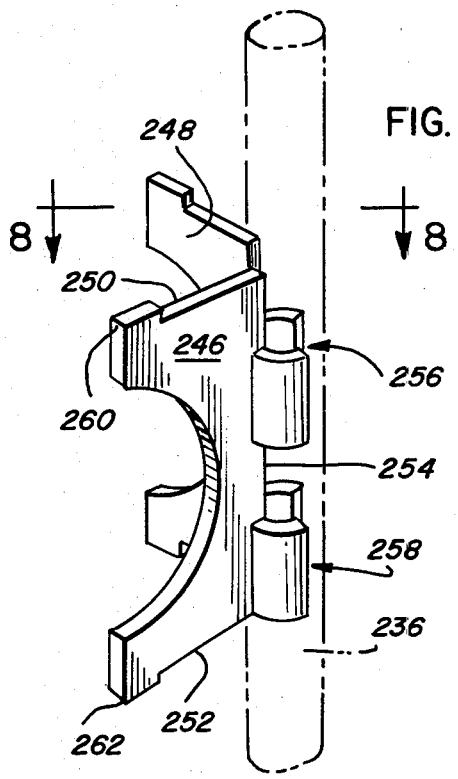
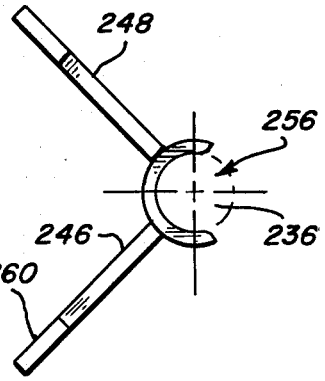
FIG. 8
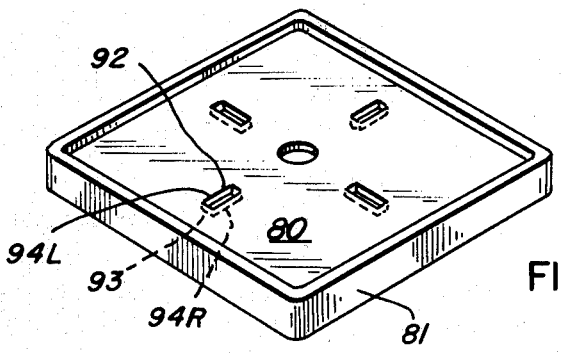
FIG. 9

SHELVING DISPLAY AND SUPPORT

TECHNICAL FIELD

The present invention relates generally to display stands and more particularly to a display stand having one or more shelves supported by columns. Injection molded, foam plastic shelves and shelf supports are used to construct a knock down display stand.

BACKGROUND OF THE INVENTION

In the sale of goods a critical parameter affecting one's success is the manner in which goods are displayed for sale. In most establishments all of the floor space available for the display of goods is used. Most of this space is filled by fixtures, display cases and shelves of a relatively permanent nature.

When new goods become available for sale, two approaches can be taken. On one hand, goods can be repositioned to make room for the new product. On the other hand, a special display stand can be set up to feature the new product. Display stands that can be easily erected and then disassembled are especially suited for this type of service.

Heretofore, special display stands have been constructed almost universally of corrugated cardboard or cardstock. They were not often designed for disassembly and reuse at a later date. Consequently such display stands were not especially rugged or adaptable to the display of various products. This was an acceptable approach when cardboard was cheap and readily available. The American Paper Institute recently estimated that the demand for such materials will increase at the rate of 10 percent and that a shortage is inevitable. In fact, the institute has identified recycled corrugated cardboard "an endangered species." New materials and approaches to display stand engineering must be found.

Ideally, a display stand used for featuring new products or special promotions of old products should be one that can be easily assembled when needed and just as easily disassembled and placed into storage when no longer needed. Furthermore, such a display stand should be versatile in that it can be easily changed to adapt to the goods to be displayed. In addition, it should be substantially rigid when assembled. Finally, the display stand should be fabricated of a material that resists deterioration during storage and one that possesses inherent strength.

SUMMARY OF THE INVENTION

According to the present invention a knock-down display stand is formed from a base, a pole supported by the base, a series of identical shelves and sets of V-shaped shelf supports hung on the pole. In order to provide a display stand that is substantially rugged and resistant to deterioration, injection molded, foam plastic materials are used.

A base, serving also as a shelf, is used to support a pole substantially erect and to carry the weight of successive tiers of shelves. Each subsequent shelf is supported by a pair of V-shaped shelf supports.

Each V-shaped shelf support features two identical flat planar wing elements. The wing elements are integrally joined together to form a "V." Two integrally formed hooks are located at the base of the "V" to attach the wings to the pole. Each hook has an inner diameter substantially equal to the outer diameter of the pole. Each wing element has two other edges perpendicular to the edge supporting the hooks. These two parallel edges are used to carry the weight of the shelves and transmit that weight to the base. Each V-shaped shelf support is "self complementary" about the axis of the hooks. By virtue of being self-complementary, two V-shaped shelf supports may be positioned to form an interlocking X-shaped shelf support. The two V-shaped shelf supports are held together by the pole.

Each shelf has a opening for receiving the pole and recesses or slots to receive the two V-shaped shelf supports interfacing with the shelf. The recess and wings mate together to form a substantially rigid structure. Subsequent shelves and shelf supports are added to the pole to create a vertical stack of shelves and shelf supports keyed to the pole. The last shelf is held on the pole by a cap. The cap sandwiches the shelves and shelf supports together against the base to form a substantially rigid display stand.

It should be noted that each pair of V-shaped shelf supports can be placed in any desired angular orientation relative to the pole and that the V-shaped shelf supports need not be placed directly atop each other or kept in the same longitudinal plane between adjacent tiers of shelves. The slots in the shelves that are used to receive the shelf supports determines the position of the shelf supports relative to the shelf. Similarly, while two cylindrical hooks are preferred, any number of individually segmented hooks may be used so long as a sufficient sector of the pole is occupied whereby the wing elements are removably joined to the pole. In all cases, the principle of the invention remains the same. The preferred embodiment is illustrated in the drawings.

Disassembly follows the reverse of the procedure used to assemble the shelves. When the display shelf is disassembled, the individual parts can easily be put away for later use. Because essentially two major components (e.g. the V-shaped shelf supports, and the shelves) are used, replacement of components and procurement of spare parts is facilitated. The V-shaped shelf supports may be used for other shelving arrangements; they are not limited to display stands.

BRIEF DESCRIPTION OF THE DRAWINGS

FIG. 1 is a perspective view of the completed display stand as viewed from a point above the display stand;

FIG. 2 is an exploded perspective view illustrating the assembly of two V-shaped shelf supports;

FIG. 3 is a perspective view of the shelf supports shown in FIG. 2 joined together for insertion about a pole;

FIG. 4 is an elevational side view of display stand shown in FIG. 1 illustrating the relationship between the shelf supports, the pole and the base;

FIG. 5 is a transverse cross sectional view of display stand shown in FIG. 4 when viewed along line 5—5 of FIG. 4;

FIG. 6 is a perspective view of a V-shaped shelf support featuring rectangular hooks (reference numbers in the 100 series are used to designate elements corresponding to the similar elements in the embodiment of FIGS. 1–5);

FIG. 7 is a perspective view of a V-shaped shelf support featuring snap fitting hooks;

FIG. 8 is a top view of the V-shaped shelf support shown in FIG. 7 when viewed along line 8—8 of FIG. 7;

FIG. 9 is a perspective view of a shelf element.

DESCRIPTION OF THE PREFERRED EMBODIMENTS

While this invention is susceptible of embodiment in many different forms there is shown in the drawings and will herein be described in detail a specific embodiment of the invention and modifications thereof, with the understanding that the present disclosure is to be considered as an exemplification of the principles of the invention and is not intended to limit the invention to the specific embodiments illustrated.

While the display stand of this invention may be made of many different materials; suitable materials include polyethylene and polypropylene. The preferred material is injection molded structural foam made of polyolefin plastic for both the shelves, the shelf supports and the other minor components of the invention. Full density linear polyethylene is transformed by a foaming agent into a so called "structural plastic." This plastic is lighter and less dense than so called full density polyethylene. It is characterized by a solid dense skin and a cellular core. Structural foam offers several advantages over full density injection molded plastic. Specifically, flexural rigidity can be increased as much as four times over that of a solid part of equal weight. For that matter, it is well known that for polyethylene as the density increases so does its strength, hardness, rigidity, and heat resistance. For these reasons, structural foam, injection molded components are preferred.

One important advantage of injection molding is that production rates are high and unit costs are low. In addition, quite intricate parts can be produced since dimensional accuracy is high. Foam plastics are noted for their strength and light weight. Since dimensional accuracy is high, interlocking of thin walled components becomes especially feasible. These three features, low cost, dimensional accuracy and high strength per unit weight, work hand in hand in solving the problem of producing an attractive low cost, knock-down, display stand.

FIG. 1 provides an illustration of the display stand of the present invention when fully assembled and ready for use. Specifically, the display stand 20 includes base shelf 22 and three identical upper shelves 24, 26 and 28 supported by pairs of V-shaped shelf supports 30, 32 and 34 between each shelf tier. The shelves and the shelf supports are keyed to and hung about a central pole 36. A top piece 38 secures the upper shelf 28 to the pole 36 and the base 22. In other words, the top piece 38 sandwiches the shelves and shelf supports between the upper shelf 28 and the base shelf 22.

FIG. 4 is a elevational view of display stand shown in FIG. 1 illustrating the interrelationships between the shelves, the shelf supports and the central pole. Specifically the central pole 36 is joined to the center of the base shelf 22 so as to form a generally upright and erect shaft. Each shelf is then inserted atop a pair of shelf supports (e.g. shelf 24 atop shelf support pair 30) until the highest or top shelf 28 has been put in place. The top shelf is held on the pole 36 by top piece 38.

Returning now to a detailed discussion of the specific components of the invention we began with the V-shaped shelf supports. V-shaped shelf supports are illustrated in FIGS. 2, 3, 6, and 7. FIG. 2 shows the shelf support pair 40 before being joined to the pole 36. FIG. 3 shows the shelf support pair 40 joined together and ready for being indexed to the pole 36. FIGS. 6 and 7 illustrate alternate variations of the V-shaped shelf supports shown in FIGS. 2 and 3.

Each shelf support pair 40 (see FIG. 2) is formed from two identical V-shaped shelf supports 42 and 44. For purposes of discussion our attention will be focused on one 44 of the two V-shaped shelf supports shown in FIG. 2.

Each V-shaped shelf support 44 includes two wing elements 46 and 48. For purposes of illustration, the wings are shown as generally flat planar structures. The flatness per se of the wings is not a restriction on the shape of each wing. Any shape will serve equally well. For example, a shelf support may be formed from two wing elements having a wedge shaped transverse cross section with the broad base of the wedge aligned to the apex of the V-shaped shelf support. Each wing 46 has two substantially parallel edges 50 and 52. These edges are used to support the shelf placed atop the wing and to carry the load or weight to the next lower shelf.

Two cylindrical hooks 56 and 58 are integrally formed along the base edge 54 of the wing 42. These hooks are integrally connected with the main body 46 of each wing to form the "V" shape of the shelf support 44. While two hooks are used throughout this discussion any number of similar hooks may be used providing the "self-complementary" characteristic (to be explained later) is satisfied. The axis of the hooks 56 and 58 is perpendicular to the two shelf support edges 50 and 52. Thus, when the two hooks are aligned along a vertical axis, the two shelf support edges 50 and 52 will fall in a lateral plane. The distance between the two lateral edges 50 and 52 determines the height between two adjacent shelves or the distance between tiers. A sufficient amount of material must remain between the two edges 50 and 52 of the wing to support the load on the upper shelf and to transmit the load to the lower shelf. Any other material may be removed. Removal of excess material reduces the weight of the wing and reduces the amount of material needed to form the wing; this reduces the overall cost of display stand. FIG. 5 illustrates a transverse cross section of the wings.

The material not considered essential for supporting shelves in each wing may be removed so as to form an ornamental shape between the two parallel edges 50 and 52. As shown in FIG. 4 a circular cut out 61 was selected to give an overall pleasant appearance. Other shapes and forms may be used.

Each parallel edge 50 and 52 of each wing 46 includes a integral raised tab 61 and 62. The tab 60 begins at a point on the parallel edge 50 furthest from the interior edge 54 of the wing element 46. Each tab 60 has a lateral length generally less than the lateral length of the corresponding parallel edge 50. These tabs 60 and 62 mate with slots in the shelves (see FIG. 9). The cooperation between the tabs 60 and the slots will be described at a later point.

An unusual and important feature of the shelving support is that each V-shaped shelf support 44 is "self-complementary." By being "self-complementary" two V-shaped shelf supports can be meshed together to form a cruciform shaped shelf support. Specifically, this relationship is shown in FIG. 2. There it should be noted that the orientation of any of one of the pair 40 of shelf supports (for example shelf support 44) is just the opposite of the other shelf support 42. In general, each shelf support can be considered symmetrical about an axis perpendicular to the axis of the hooks and bisecting the angle between the two wings. Because of this "symmetrical" property any one V-shaped shelf support can be oriented in any one of two possible axial orientations such that with another shelf support in the opposite orientation the two will form a complementary interlocking structure.

Returning to the hooks, each hook 56 and 58 is integrally joined to the two wings 46 and 48 with a longitudinal axis at the vertex of the two wings. Each hook is in the shape of a right cylinder. Hooks in the shape of rectangular channel may be used if a square pole is used (See FIG. 6). The important characteristic being that each hook occupies generally more than one hundred eighty degrees or one-half of the perimeter of the pole so as to grip the pole.

In one variation, the hooks can be made to "snap lock" to the pole (see FIGS. 7 and 8). In this case, each hook would occupy a sector generally more than one-half of the perimeter of the pole but substantially less than the total perimeter of the pole (see FIG. 8). One advantage of this embodiment is that the V-shaped shelf supports can be joined to the pole radially and independent of its complementary wing. In other words, the shelf support pair would not have to be brought together first and then joined to the pole.

In any case, one hook 68 has an edge adjacent to one edge 50 of the two parallel edges 50 and 52. The second hook 56 has an edge located at the mid plane between the two parallel wing edges. The inner diameter of the hooks is substantially the same as the outer diameter of the pole 36 upon which the shelf supports are hung. An inherent feature of the wings is that the two cylinders 56 and 58 are coaxial, open ended right cylinders.

As illustrated in FIG. 2 the length of each cylindrical hook 56 and 58 is approximately equal to one-quarter the longitudinal distance between the two parallel edges 50 and 52. This is not an essential requirement. By making the hooks of this length, the V-shaped shelf support pair 42 and 44 when joined will form a stack of four generally contiguous right cylinders beginning and ending between the two parallel edges 50 and 52 with no gaps between adjacent hooks. If the hooks or cylinders have a height less than one-quarter of distance between the two parallel edges 50 and 52, then there would be gaps between the hooks; however, the hooks would still interlock together about the pole 36. If the length of each hook was greater than one-quarter the distance between the two parallel edges 50 and 52, it would not be possible to intermesh the four wings about the pole. This is because there would be interference between two mutually perpendicular pairs of wings. This requirement (of providing sufficient space between adjacent hooks on the same V-shaped shelf support such that a another pair of hooks fills the space without interference) is best viewed as a "form" requirement that the hooks and spaces between hooks taken together should be "complementary" relative to the axis of the hooks.

Adding more than two cylindrical hooks per V-shaped shelf support may be advisable if (after considering the diameter of the pole) there was a relativey large distance between adjacent tiers of shelves, or if it would be easier to fabricate "short fat" hooks than "thin long" long hooks. In any case, the preferred embodiment employs at least two hemi-cylindrical hooks positioned as illustrated in the drawings.

Because injection molding techniques are recommended, there should be sufficient dimensional precision between various wings forming the shelf support that a generally smooth, contiguous, cylindrical structure is formed when the four wings are brought together as shown in FIG. 3.

Finally, it should be noted that the drawings illustrate V-shaped shelf supports having a ninety degree angle between wing elements (ex. see FIG. 8). This is by no means a design requirement. Acute as well as oblique angles may be used depending upon the preference of the designer.

The pole may be of any convenient cross-sectional shape (e.g., round, square, hexagonal, etc.). The cross-sectional shape of the pole determines the shape of the hooks joined to the wing elements (e.g. round poles have circular hooks, etc.) A round pole is preferred.

Turning to the shelves, each shelf has essentially the same characteristics. That is, each has a generally flat lateral plane 80 (see FIGS. 5 and 9) and a peripheral circumferential lip 81 (See FIG. 4). The upper portion of the lip serves to prevent the goods and packages from slipping off the shelf top. The lower portion of the lip provides a reinforcing rib along the outer edges of the shelf to resist the tendency of the shelf to warp or buckle when loaded.

Although the shelves shown in the drawings are generally square, any shape may be used. Similarly, although the shelves shown in the drawings have a central opening or bore through which the pole is passed, the shelves may have more than one opening or openings that are not centrally located. For example, if the shelves were to assume a generally rectangular configuration (i.e., such is normally associated with bookshelves) the shelves would have two holes centered along the two narrow edges of the rectangular shelf and at either end. Other shapes and sizes are possible. In particular, the shelves may be stacked like a "wedding cake" with small shelfs at the top and larger shelves at the bottom. One advantage of using shelves of the same shape is that they may be interchanged between tiers. In addition, replacement and procurement of spare parts is that much easier. As can be best seen in FIG. 9, each shelf has four spaced openings 92, each opening having front and rear walls 93, and left and right side walls 94L and 95R, respectively. Openings 92 coact with the tabs 60 and 62 on the wing members to hold the shelf support means against rotation.

The lowest shelf or base shelf 22 (see FIG. 4) is essentially identical to the other shelves with the two exceptions. The lower lip 59 is extended so as to form a peripheral flange around the shelf. In addition, the lower shelf contains a cavity or bore 63 into which the pole 36 is anchored. In particular, the pole 36 is shown threadably joined to the bore 63 of the base 22. The length of the bore 63 and the flange 59 is such that all of their edges lie in the same plane. This provides sufficient rigidity to the display stand to hold the pole in a substantially erect vertical direction. In addition, the peripheral flange resists the tendency of the display stand to tip particularly when the display stand is in a "top heavy" condition.

At the opposite end of the display stand 20 is the top piece 38. The top piece 38 may be of any convenient shape. It includes a central bore 81 through which the opposite end of the pole 36 is threadably joined. It should be noted that other methods besides threaded joints may be used to connect the pole 36 to the top piece 38 and to base shelf 22. Threaded joints may prove to be the easiest to use. The top piece 38 serves to compress the shelves and the shelf supports together along the pole 36 so as to hold the shelves and shelf supports in a substantially rigid structure. The top piece 38 also resists tendency of the top shelf 28 to tip. While one central pole 36 is shown in the drawings, several poles may be used to form a stand of shelves. In any case, the principal is still the same. The shelf support wings interlock and are held together by the pole and with a shelf being placed at either end of the shelf support. The shelves and shelf supports are held together by a top piece to form a rigid upright structure.

The relationship between the tabs 60 and 62 at each axial end 50 and 52 of the wing elements and the slots in the shelves will now be explained. The tip of each wing 46 contains a tab 60 that interlocks and joins with a slot 92 in the plane of the shelf 80. The tab 52 and slot 92 are dimensioned so as to form a substantially close fit along at least three exterior sides of the tab and slot. Depending on the thickness of shelve 80, the depth of the slot 92 may be such that it is in communication with the corresponding slot on either side of the shelf so as to form a contiguous opening. It is not a requirement that the slots on either side of the shelf 80 join together to form an opening or aperture.

What is important is that the outermost edge 83 of the tab 60 and the outermost edge 93 of the slot 92 abut each other. The abutment of the tab and slot edges 83 with 93 insures that any upsetting moment or load applied to a shelf edge is transferred to the opposite supporting wing element to form a stabilizing moment. By keeping the edge 83 of the tab 60 in abutment with the corresponding edge 93 of the slot 92 the force on the shelf urging a downward displacement results in the force being transferred to the supporting wing element 46 and to the integrally connected hooks 56 and 58 joining the shelf support 44 to the pole 36. Similarly if a load is placed between any two tabs 60 and 70, a force component of that load will be transferred to edges 94 of the slots 92 closest to the load. This force component is then transferred to the corresponding edge 84 of the tab 60 mated to that slot 92 and to the wing element 46 and hooks 56 and 58. It should be appreciated that in the absence of tabs and cooperating slots the V-shaped shelf supports 42 and 44 could be readily rotated about the pole 36 until engagement was made with the wing element of the other V-shaped shelf support wing element. By way of analogy, in the absence of tabs and slots there would not be a rigid relationship between the V-shaped shelf supports and the shelf. In other words a certain degree of "slip" would occur between the wing edges and the shelf when the shelf was loaded. Once the load is transferred to the hooks 56 and 58 a moment or force component is also transferred to the opposite V-shaped shelf support and to the corresponding tabs and slots. Since the V-shaped shelf support pair 40 and shelf are compressed together by the top piece, the downward moment on the V-shaped shelf support pair results in an upward moment on the opposite V-shaped shelf support which (again because of the close abutting relationship between the tabs and slots) results in a force being applied to the opposite side of the shelf which in turn tends to resist or relieve the load initially applied. Thus, the tabs and slots substantially contribute to the overall strength and effectiveness of the display stand and shelf supports.

It should be understood that should it become necessary to take apart the display stand illustrated in the drawings it only becomes necessary to reverse the steps which were used to assemble the display stand. In particular, the shelves being generally of identical configuration and shape are easily stacked together. The wings each being of the same shape may be interleafed or stored in a stacked array. Similarly the pole and top piece are easily removed and placed in storage.

From the foregoing, it will be observed that numerous variations and modifications may be effected without departing from the true spirit and scope of the novel concept of the invention. It will be understood that no limitation with respect to the specific apparatus illustrated herein is intended or should be inferred. It is, of course, intended to cover by the appended claims all such modification modifications as fall within the scope of the claims.

What is claimed is as follows:

1. A stand for packaged goods, beverages and the like, comprising: a pole; a base having a passage adapted to receive said pole therein and to support said pole in vertical orientation; at least one shelf, said shelf having a passage adapted to receive said pole therein for positioning said shelf in a horizontal disposition; and support means between said base and said shelf for holding said shelf in spaced relationship with respect to said base, said support means including first and second wing pairs, each wing of each pair including a top edge adapted to bear against said shelf, a bottom edge adapted to bear against said base, and a side edge common to the wings of each pair and disposed perpendicularly to the top and bottom edges of each wing, each wing pair further including first and second spaced hooks formed integrally with its wings at the side edge thereof, the hooks of the first wing pair being internested with the hooks of the second wing pair and said internested hooks collectively defining a passage for receiving said pole therein, whereby when said pole is received in the passages in said base, shelf and hooks, said wings bear against said base and said shelf to support said shelf in spaced relationship with respect to said base.

2. A stand as set forth in claim 1 including a plurality of shelves, and support means beneath each shelf for supporting it in spaced relationship with respect to an adjacent shelf.

3. A stand as set forth in claim 1 including cap means removably joined to the upper end of said pole for holding said shelf pressed against said support means and said base.

4. A stand as set forth in claim 1 wherein the passages in said base and said shelf are centrally disposed.

5. A stand as set forth in claim 1 in which said pole and said passages are circular in cross-section, and wherein said hooks are right cylinders.

6. A stand as set forth in claim 1 wherein the top and bottom edges of said wings are rectilinear, and parallel with one another.

7. A stand as set forth in claim 1 wherein the wings of each pair are perpendicular to one another.

8. The display stand defined in claim 1, wherein said shelf includes an integrally formed lip extending upwardly from the upper surface of said shelf along the edge of said shelf.

9. The display stand defined in claim 8, further including an integrally formed lip extending downwardly from the lower surface of said shelf along the edge of said shelves, said upper and lower lip defining a flange along the perimeter of said shelf.

10. The display stand defined in claim 1, wherein said pole is threaded at each end, said pole being threadably attached to said base at one end and wherein cap means is threadably attached at the other end of said pole.

11. The display stand defined in claim 1, wherein each of said V-shaped shelf supports includes at least one integrally formed hook, said hook being keyed to said pole to anchor said supporting means to said pole, said hook cooperating with said pole to the extent of occupying generally more than one-half of the perimeter of said pole.

* * * * *